US005940055A

United States Patent [19]

Lee

[11] Patent Number: 5,940,055

[45] Date of Patent: Aug. 17, 1999

[54] LIQUID CRYSTAL DISPLAYS WITH ROW-SELECTIVE TRANSMITTANCE COMPENSATION AND METHODS OF OPERATION THEREOF

[75] Inventor: Gyu-Su Lee, Kyungki-do, Rep. of Korea

[73] Assignee: Samsung Electronics Co., Ltd., Rep. of Korea

[21] Appl. No.: 08/816,866

[22] Filed: Mar. 13, 1997

[30] Foreign Application Priority Data

Mar. 15, 1996 [KR] Rep. of Korea ..... 96-7012

[51] Int. Cl.[6] ..... G09G 3/36

[52] U.S. Cl. ..... 345/87; 345/205; 345/92; 345/90

[58] Field of Search ..... 345/90, 92, 94, 345/95, 69, 204, 87, 98, 93, 205, 206, 21; 349/38; 2/205, 206, 211

[56] References Cited

U.S. PATENT DOCUMENTS 5,359,206 10/1994 Yamamoto et al. ..... 257/59
5,561,440 10/1996 Kitajima et al. ..... 345/87

*Primary Examiner*—Richard A. Hjerpe
*Assistant Examiner*—Francis N. Nguyen
*Attorney, Agent, or Firm*—Myers Bigel Sibley & Sajovec

[57] ABSTRACT

A liquid crystal display (LCD) includes a plurality of thin-film-transistor (TFT) LCD elements arranged in a plurality of rows, a respective one of the TFT LCD elements including a liquid crystal element having a pixel electrode and a common electrode, a storage capacitor having a first electrode and a second electrode connected to the pixel electrode, and a transistor having a controlled electrode connected to the pixel electrode and a gate electrode which controls current through the controlled electrode. A common electrode voltage is applied to the common electrodes of the liquid crystal elements of the plurality of TFT LCD elements. A respective gate driving voltage is applied to the gate electrodes of a respective row of the TFT LCD elements and to the first electrodes of the storage capacitors of another row of TFT LCD elements other than a first row of TFT LCD elements. A periodic driving voltage is applied to the first electrodes of the storage capacitors of the first row of TFT LCD elements, the periodic driving voltage having a magnitude and a DC bias sufficient to operate the first row of LCD elements according to a first predetermined transmittance characteristic. Related circuits and methods are also discussed.

22 Claims, 5 Drawing Sheets

LIQUID CRYSTAL DISPLAYS WITH ROW-SELECTIVE TRANSMITTANCE COMPENSATION AND METHODS OF OPERATION THEREOF

CROSS-REFERENCE TO RELATED APPLICATION

This application is related to U.S. application Ser. No. 08/808,340, entitled THIN-FILM TRANSISTOR LIQUID CRYSTAL DISPLAY DEVICES HAVING HIGH RESOLUTION (Attorney Docket No. 5649-241), filed Feb. 28, 1997, the disclosure of which is incorporated by reference herein in its entirety.

FIELD OF THE INVENTION

The present invention relates to liquid crystal displays (LCDs) and methods of operation thereof, more particularly, to thin film transistor (TFT) LCDs and methods of operation thereof.

BACKGROUND OF THE INVENTION

Active thin film transistor (TFT) LCDs are becoming increasingly popular due to the generally superior image quality which these displays can provide in comparison to, for example, passive displays. A typical TFT LCD includes a plurality of TFT LCD elements which include a liquid crystal element including a pair of electrodes which sandwich a portion of liquid crystal material, typically a twisted nematic (TN) liquid crystal material. A voltage applied across the electrodes by a TFT integrated with the liquid crystal element can be used to modulate the amount of light transmitted through the liquid crystal material.

As illustrated in FIG. 1, a TFT LCD element typically includes a thin-film transistor TFT which has a first controlled electrode connected to a data line Dn and a second controlled electrode connected to an electrode of a liquid crystal element, here shown as a liquid crystal capacitance Clc connected between the thin film transistor TFT and a common electrode Vcom. A voltage typically is applied across the liquid crystal capacitance Clc by driving the gate of the thin-film capacitor TFT to turn on the transistor TFT and applying a voltage from the data line Dn to the liquid crystal element Clc. The voltage, i.e., the data, is maintained across the liquid crystal element Clc after the transistor TFT is turned off due to the capacitance of the element Clc and a storage capacitor Cst connected to the liquid crystal element Clc. In a conventional LCD, the storage capacitors of a particular row of LCD elements typically are connected to the gate line which drives the TFTs of an adjacent row of LCD elements. However, for the first row of LCD elements driven by a first gate line G1, the storage capacitors Cst are connected to a dummy gate line G0 which typically is not used to drive thin-film transistors.

As illustrated in FIG. 2, the common electrodes Vcom are typically driven by a voltage having a periodic waveform. During a time Ton when the transistor TFT is driven "on" by the gate line G1, a voltage Vp is applied to the liquid crystal element Clc, causing a voltage Vlc to be established across the liquid crystal element Clc, which is maintained after the transistor TFT is turned "off." The dummy gate line typically is driven by a periodic voltage Voff, resulting in a voltage Vst across the storage capacitor Cst. The voltage VG0 used to drive the dummy gate line G0 typically is the same as the "off" portion of the gate driving voltage VG1 used to drive the gate of the transistor TFT.

Unfortunately, this method of driving the first row of LCD elements may cause nonuniform performance for the LCD. Because the impedance of the dummy gate line G0 may differ from the impedance of the regular gate line G1 due to the lack of the additional capacitance provided by the gates of the thin-film transistors TFT, the first row of LCD elements may perform differently than the other rows of LCD elements in the LCD. Reduced capacitance on the dummy gate line may allow the liquid crystal elements to more quickly discharge. Thus, if normally "white" mode LCD elements are employed in the LCD, i.e., elements which become transparent when less voltage is applied across the liquid crystal element Clc, the first row of LCD elements may appear brighter than the other rows of the display.

SUMMARY OF THE INVENTION

In light of the foregoing, it is an object of the present invention to provide liquid crystal displays (LCDs) and methods of operation thereof which can provide for more uniform transmittance across the rows of the display.

This and other objects features and advantages are provide according to the present invention by LCDs and methods of operating thereof in which the dummy gate line connected to the storage capacitors of a first row of LCD elements of an LCD is driven by a periodic driving voltage which has a magnitude and DC bias sufficient to operate the first row of LCD elements according to a first predetermined transmittance characteristic. The other rows of the LCD may operate according to a second predetermined transmittance characteristic, and the first predetermined characteristic preferably approximates the second predetermined transmittance characteristic to troy provide more uniform performance across the rows of the LCD. The periodic driving voltage may be produced by a voltage transforming circuit which is coupled to the storage capacitors of the first row of LCD elements and is responsive to a common electrode voltage used to drive the common electrodes of the liquid crystal elements of the LCD elements.

In particular, according to the present invention, a liquid crystal display (LCD) includes a plurality of thin-film-transistor (TFT) LCD elements arranged in a plurality of rows, a respective one of the TFT LCD elements including a liquid crystal element having a pixel electrode and a common electrode, a storage capacitor having a first electrode and a second electrode connected to the pixel electrode, and a transistor having a controlled electrode connected to the pixel electrode and a gate electrode which controls current through the controlled electrode. Common electrode driving means, connected to the common electrodes of the liquid crystal elements of the plurality of TFT LCD elements, apply a common electrode voltage to the common electrodes of the liquid crystal elements of the plurality of TFT LCD elements. Gate driving means, electrically connected to the gate electrodes of the plurality of TFT LCD elements, apply a respective gate driving voltage to the gate electrodes of a respective row of the TFT LCD elements and to the first electrodes of the storage capacitors of another row of TFT LCD elements other than a first row of TFT LCD elements. First row storage capacitor driving means, responsive to the common electrode driving means and electrically connected to the first electrodes of the storage capacitors of the first row of TFT LCD elements, apply a periodic driving voltage to the first electrodes of the storage capacitors of the first row of TFT LCD elements, the periodic driving voltage having a magnitude and a DC bias sufficient to operate the first row of LCD elements according to a first predetermined transmittance characteristic. Preferably, the rows of TFT LCD elements other than the first row of TFT LCD elements operate according to a second predetermined transmittance characteristic and the first predetermined transmittance characteristic approximates the second predetermined transmittance characteristic. The periodic driving voltage also preferably has a predetermined phase with respect to the common electrode voltage.

The first row storage capacitor driving means preferably includes a voltage transforming circuit including an input node and an output node, the input node being electrically connected to the common electrodes of the plurality of TFT LCD elements, the voltage transforming circuit producing a periodic voltage at the output node, the periodic voltage having a predetermined phase, a predetermined magnitude and a predetermined DC bias with respect to the common electrode voltage. Means are provided for coupling the output node of the voltage transforming circuit to the first electrodes of the storage capacitors of the first row of TFT LCD elements to thereby produce the periodic driving voltage on the first electrodes of the storage capacitors of the first row of TFT LCD elements from the generated periodic voltage. The coupling means may include a dummy gate line connected to the first electrodes of the storage capacitors of the first row of the plurality of TFT LCD elements and a gate driver, electrically connected to the output node of the voltage transforming circuit and to the dummy gate line, which receives the generated periodic voltage and produces the periodic driving voltage on the dummy gate line therefrom.

According to a first embodiment, the voltage transforming circuit includes a resistor having a first electrode and a second electrode, the first electrode being connected to a first voltage source. The circuit includes a diode having anode and a cathode, the cathode being connected to the second electrode of the resistor. A capacitor has a first electrode connected to the common electrodes of the plurality of TFT LCD elements and a second electrode connected to the anode of the diode. The circuit also includes a first transistor, preferably a PMOS transistor, which has a first controlled electrode, a second controlled electrode, and a gate electrode with controls current between the first and second controlled electrodes, the first controlled electrode being connected to the second electrode of the capacitor and the gate electrode being connected to a second voltage source. A second transistor, preferably an NMOS transistor, has a first controlled electrode, a second controlled electrode and a gate electrode which controls current between the first and the second controlled electrodes, with the first controlled electrode being connected to the anode of the diode, the gate electrode being connected to the second voltage source, and the second controlled electrode being connected to the second controlled electrode of the first transistor at the output node. The first and second voltage sources supply respective first and second predetermined DC voltages which bias the voltage transforming circuit to produce a periodic voltage at the output node which is sufficient to operate the first row of LCD elements according to the first predetermined transmittance characteristic.

According to a second embodiment, the voltage transforming circuit also includes a second capacitor having a first electrode and a second electrode, the first electrode being connected to the second controlled electrodes of the first and second transistors at the output node, and a second diode having an anode connected to the second electrode of the second capacitor and a first electrode connected to a third voltage source. According to a third embodiment, the anode of the second diode and the second electrode of the second capacitor are connected at the output node. For the second and third embodiments, the first, second and third voltage sources supply respective first, second and third predetermined DC voltages which bias the voltage transforming circuit to produce a periodic voltage at the output node which is sufficient to operate the first row of LCD elements according to a predetermined transmittance characteristic.

According to method aspects of the present invention, a common electrode voltage is applied to the common electrodes of the liquid crystal elements of the plurality of TFT LCD elements. A respective gate driving voltage is applied to the gate electrodes of a respective row of the TFT LCD elements and to the first electrodes of the storage capacitors of another row of TFT LCD elements other than a first row of TFT LCD elements. A periodic driving voltage is applied to the first electrodes of the storage capacitors of the first row of TFT LCD elements, the periodic driving voltage having a magnitude and a DC bias sufficient to operate the first row of LCD elements according to a first predetermined transmittance characteristic. The steps of applying a common electrode voltage and applying a respective gate driving voltage may cause the rows of TFT LCD elements other than the first row of TFT LCD elements to operate according to a second predetermined transmittance characteristic and the step of applying a periodic driving voltage may include applying a periodic driving voltage to the first electrodes of the storage capacitors of the first row of TFT LCD elements having a magnitude and a DC bias sufficient to operate the first row of LCD elements according to a first predetermined transmittance characteristic which approximates the second predetermined transmittance characteristic. Preferably, the periodic driving voltage has a predetermined phase with respect to the common electrode voltage. More uniform performance over the rows of the LCD can thereby be provided.

BRIEF DESCRIPTION OF THE DRAWINGS

Some of the objects and advantages of the present invention having been stated, others will be more fully understood from the detailed description that follows and by reference to the accompanying drawings in which.

DESCRIPTION OF PREFERRED EMBODIMENTS

Figure 1:
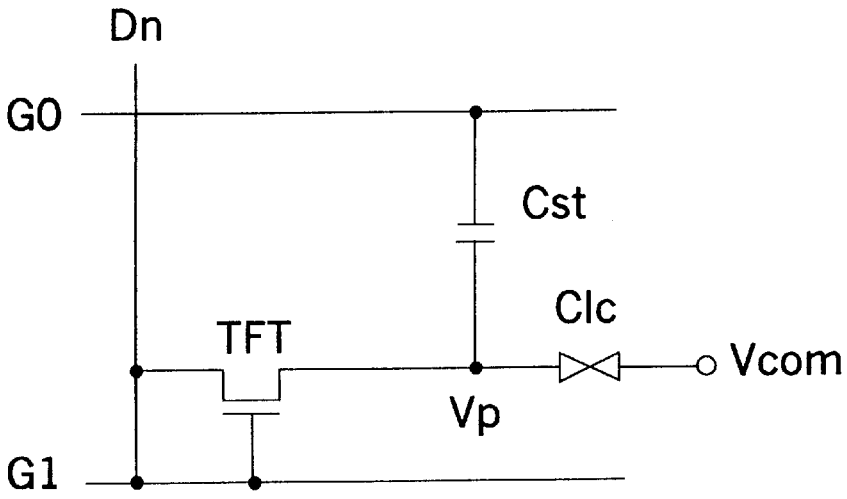
FIG. 1 Prior Art
FIG. 1 illustrates a thin-film transistor (TFT) liquid crystal display (LCD) according to the prior art.

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements throughout. The following discussion relates to operation of a liquid crystal panel comprising a plurality of "normally white" mode LCD elements. Those skilled in the art will appreciate that the present invention is also applicable to other LCD elements.

Figure 3:
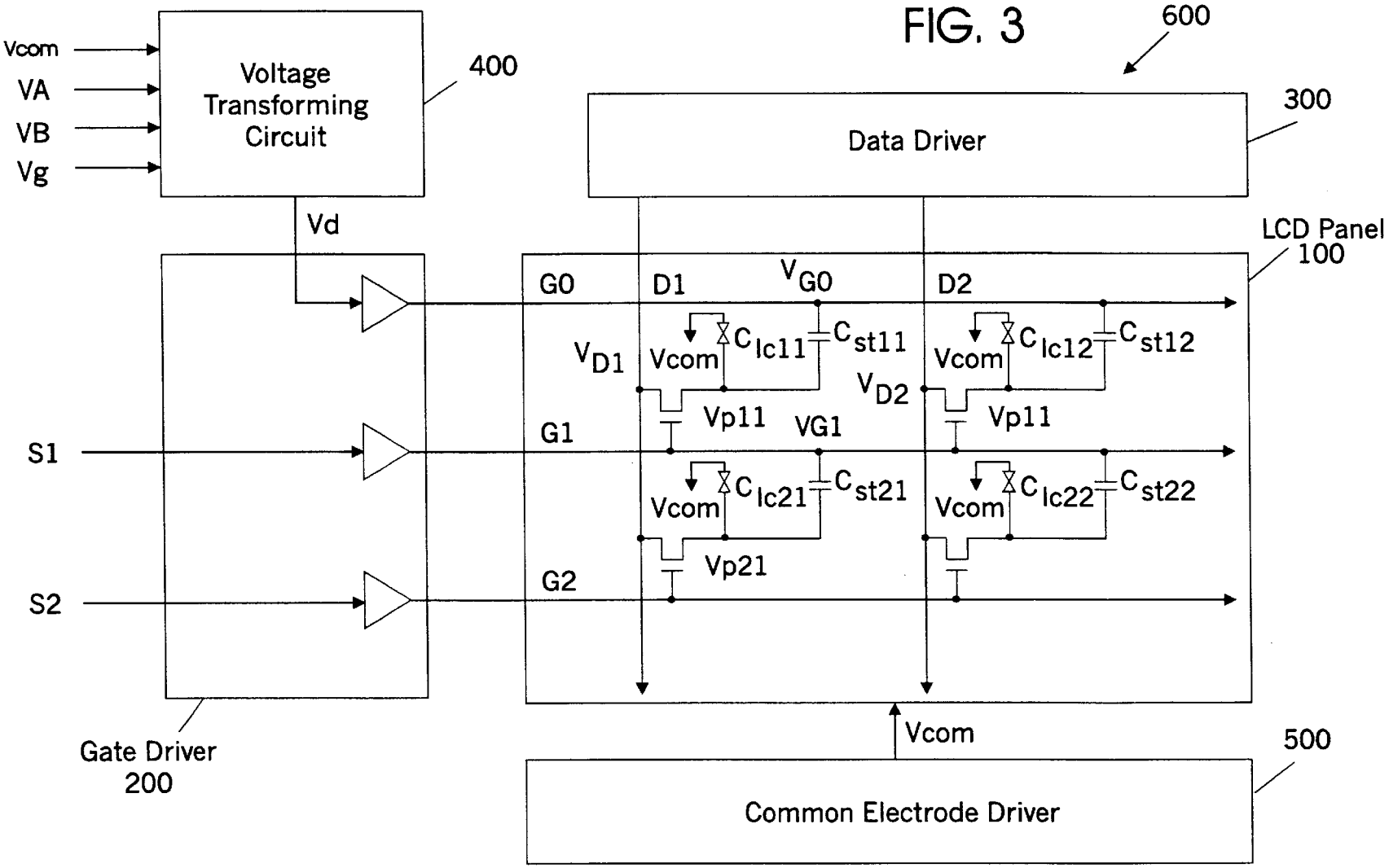
FIG. 3 illustrates a preferred embodiment of an LCD according to the present invention.

Referring to FIG. 3, a preferred embodiment of a thin film transistor (TFT) liquid crystal display (LCD) 600 according to the present invention includes a liquid crystal panel 100, a gate driver 200, a data driver 300, and a voltage transforming circuit 400. The gate driver 200 applies gate driving voltages $V_{G1}$, $V_{G2}$ to a plurality of normal gate lines G1, G2 of the LCD panel 100, as well as a periodic driving voltage $V_{G0}$ to a dummy gate line G0 of the LCD panel 100. The data driver 300 applies data voltages to a plurality of data lines D1, D2 of the LCD panel 100. A common electrode driver 500 applies a common electrode voltage Vcom to the LCD panel 100.

The LCD panel 100 includes a plurality of LCD elements $LCD_{11}$, $LCD_{12}$, $LCD_{21}$, $LCD_{22}$ arranged in rows and columns. Those skilled in the art will appreciate that the number of LCD elements in the panel 100 is not limited to the LCD elements $LCD_{11}$, $LCD_{12}$, $LCD_{21}$, $LCD_{22}$ illustrated, and that the LCD panel 100 may contain several hundred or more rows and columns of LCD elements. Each of the LCD elements $LCD_{11}$, $LCD_{12}$, $LCD_{21}$, $LCD_{22}$ includes a liquid crystal element $C_{lc11}$, $C_{lc12}$, $C_{lc21}$, $C_{lc22}$ and a storage capacitor $C_{st11}$, $C_{st12}$, $C_{st21}$, $C_{st22}$ which are controlled by a thin film transistor $TFT_{11}$, $TFT_{12}$, $TFT_{21}$, $TFT_{22}$. Common electrodes of the liquid crystal elements $C_{lc11}$, $C_{lc12}$,$C_{lc21}$, $C_{lc22}$ are commonly connected to the common electrode driver 500, thus applying the common electrode voltage Vcom thereto. Pixel electrodes of a respective one of the liquid crystal elements $C_{lc11}$, $C_{lc12}$,$C_{lc21}$, $C_{lc22}$ are connected to a first controlled electrode of respective thin film transistor $TFT_{11}$, $TFT_{12}$, $TFT_{21}$, $TFT_{22}$. The gate electrodes of a respective row of thin film transistors $TFT_{11}$, $TFT_{12}$, $TFT_{21}$, $TFT_{22}$ are connected to a respective gate line G1, G2, and second controlled electrodes of a respective column of the transistors $TFT_{11}$, $TFT_{12}$, $TFT_{21}$, $TFT_{22}$ are connected to a respective data line D1, D2. The gate line G1 is also connected to first electrodes of the storage capacitors $C_{st21}$, $C_{st22}$ of an adjacent row of LCD elements $LCD_{21}$, $LCD_{22}$. A dummy gate line G0 is connected first electrodes of the storage capacitors $C_{st11}$, $C_{st12}$ of a first row of LCD elements $LCD_{11}$, $LCD_{12}$.

The gate driver 200 applies gate driving voltages to the gate lines G1,G2 to control the transistors connected thereto, for example, by external control signals S1, S2 supplied to the gate driver 200. According to the illustrated embodiment, the gate driver 200 also applies a periodic driving voltage $V_{G0}$ to the dummy gate line G0 in response to a periodic voltage Vd supplied by the voltage transforming circuit 400. The gate driver 200 preferably is a special purpose LCD gate driving integrated circuit (IC) of the type commonly used for driving gate lines of an LCD panel, and may include components such as buffers, amplifiers, filters, control logic and the like, the operation of which is well-known to those skilled in the art and need not be discussed in detail herein. The data driver 300 preferably comprises a special purpose IC data driving IC of the type commonly used to drive data lines of an LCD panel, and may include components such as buffers, amplifiers, filters, control logic and the like, the operation of which is well-known to those skilled in the art and need not be discussed in detail herein. Similarly, the common electrode driver 500 preferably comprises a special purpose IC data driving IC of the type commonly used to drive the common electrode of an LCD panel, and may include components such as buffers, amplifiers, filters, control logic and the like, the operation of which is well-known to those skilled in the art and need not be discussed in detail herein. Those skilled in the art will appreciate that although the preferred embodiment illustrated in FIG. 3 includes a separate gate driver IC, data driver IC, common electrode driver IC, and voltage transforming circuit, the functions of these elements may be combined in one or more components or distributed among additional components. For example, the functions of these components may be integrated with the LCD panel 100, or may be implemented in a single IC designed to operate the LCD panel.

The voltage transforming circuit 400 preferably is connected to the common electrodes of the liquid crystal elements $C_{lc11}$, $C_{lc12}$,$C_{lc21}$, $C_{lc22}$ such that the common electrode voltage Vcom is applied to the voltage transforming circuit 400. In addition, first, second and third voltage sources VA, VB, and Vg are connected to the voltage transforming circuit 400. As will be described in detail herein, these voltage sources preferably supply DC voltages which bias the voltage transforming circuit 400 to produce a periodic voltage Vd which, when coupled to the first electrodes of the storage capacitors of the first row of LCD elements $LCD_{11}$, $LCD_{12}$, is sufficient to operate the first row of LCD elements $LCD_{11}$, $LCD_{12}$ according to a predetermined transmittance characteristic.

Figure 4:
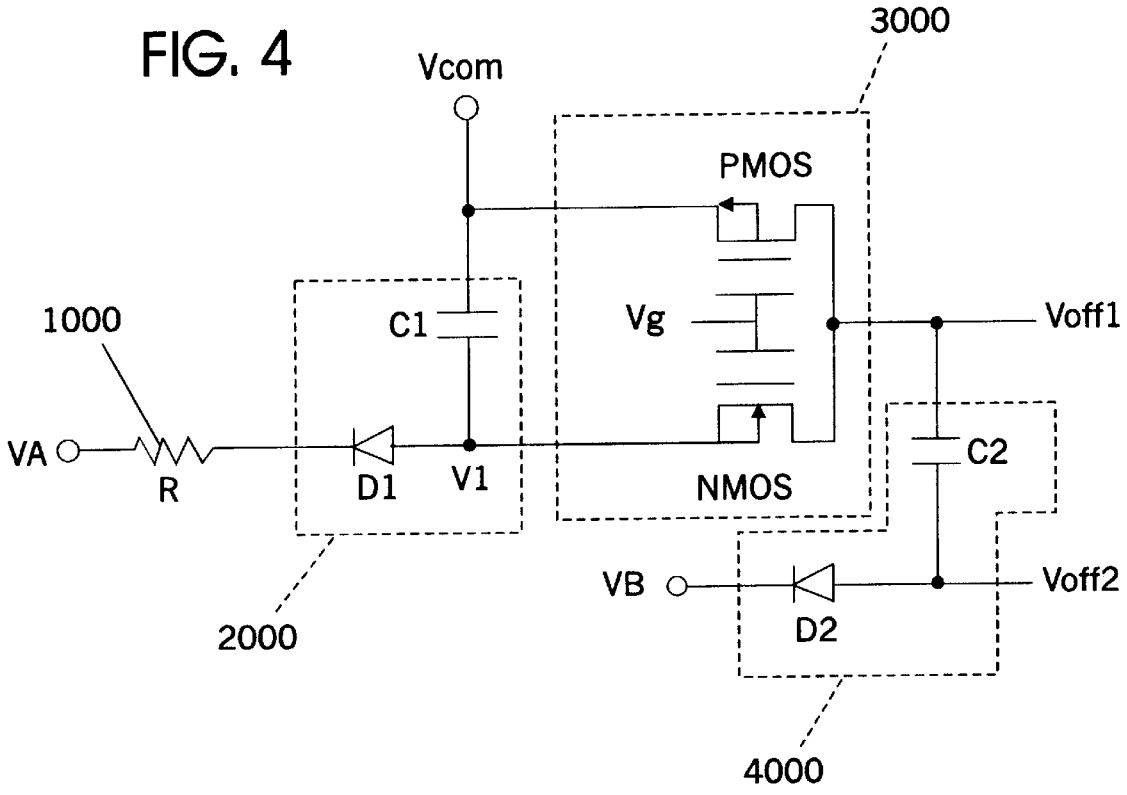
FIG. 4 illustrates an embodiment of a voltage transforming circuit according to the present invention.

FIG. 4 illustrates embodiments of a voltage transforming circuit 400 according to the present invention. A resistor R is connected to a first voltage source VA and to the cathode of a first diode D1 in a first clamping circuit 2000. The anode of the first diode D1 is connected to a first electrode of a first capacitor C1 and a first controlled electrode of a first transistor, preferably an NMOS field effect transistor NMOS. A second electrode of the first capacitor C1 is connected to a first controlled electrode of a second transistor, preferably a PMOS field effect transistor PMOS, and to the common electrodes of the LCD panel 100 of FIG. 3, to thereby couple the common electrode driving voltage Vcom to the voltage transforming circuit 400. Second controlled electrodes of the first and second transistors PMOS, NMOS are connected at a first output node Voff1. Gate electrodes of the first and second transistors PMOS, NMOS are commonly tied to a second voltage source Vg, forming a complementary MOS structure 3000. A second clamping circuit 4000 may be included which comprises a second capacitor C2 connected to the second controlled electrodes of the first and second transistors PMOS, NMOS and a second diode D2 having an anode connected to the second capacitor C2 at a second output node Voff2 and a cathode connected to a third voltage source VB.

According to first and second embodiments, the first output node Voff1 is coupled to the first electrodes of the storage capacitors $C_{st11}$, $C_{st12}$ of the first row of LCD elements $LCD_{11}$, $LCD_{12}$ of the LCD panel 100 by means such as the gate driver 200 of FIG. 3, with or without the second clamping circuit 4000 being present. According to a third embodiment, the second clamping circuit 4000 is present, and the second output node Voff2 is coupled to the first electrodes of the storage capacitors $C_{st11}$, $C_{st12}$ of the first row of LCD elements $LCD_{11}$, $LCD_{12}$ of the LCD panel 100 by means such as the gate driver 200 of FIG. 3. Preferably the first, second and third voltage sources VA, Vg, VB supply DC voltages which bias the voltage transforming circuit 400 such that the periodic voltage produced at the first or second output nodes Voff1, Voff2 produces a periodic driving voltage $V_{G0}$ on the dummy gate line G0 which has a magnitude and DC bias which is sufficient to operate the first row of LCD elements $LCD_{11}$, $LCD_{12}$ according to a predetermined transmittance characteristic, preferably a transmittance characteristic approximating that of the other rows of LCD elements. By controlling the first, second and third voltages supplied by the first, second and third voltage sources VA, Vg, VB, as well as the value of the resistor R, the magnitude and DC bias of the periodic voltage produced by the voltage transforming circuit 400 can be varied to control the brightness of the first row of LCD elements $LCD_{11}$, $LCD_{12}$.

Figure 7:
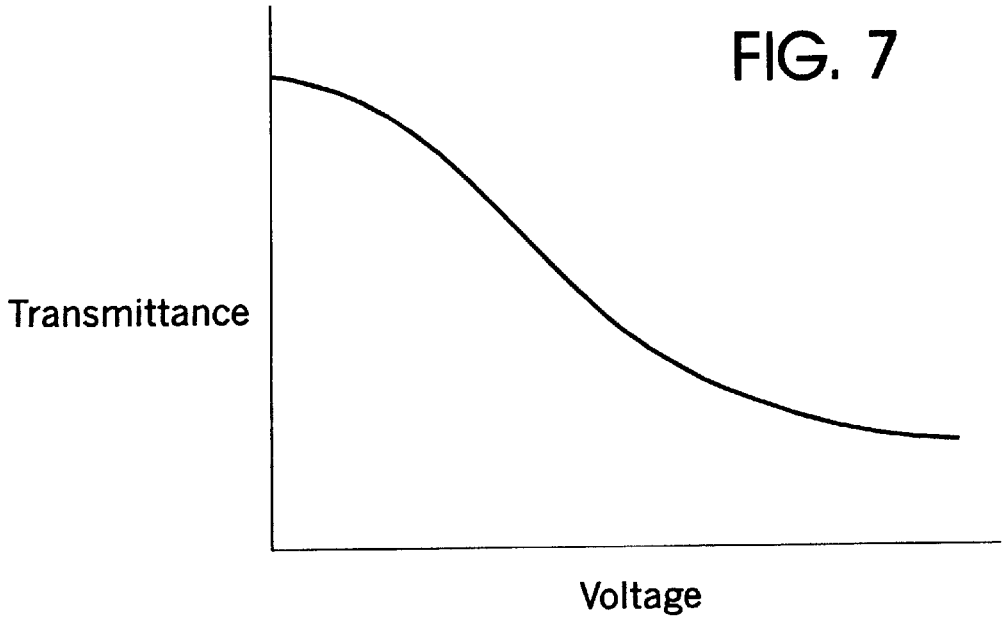
FIG. 7 illustrates transmittance vs. voltage for an LCD element.
Figure 2:
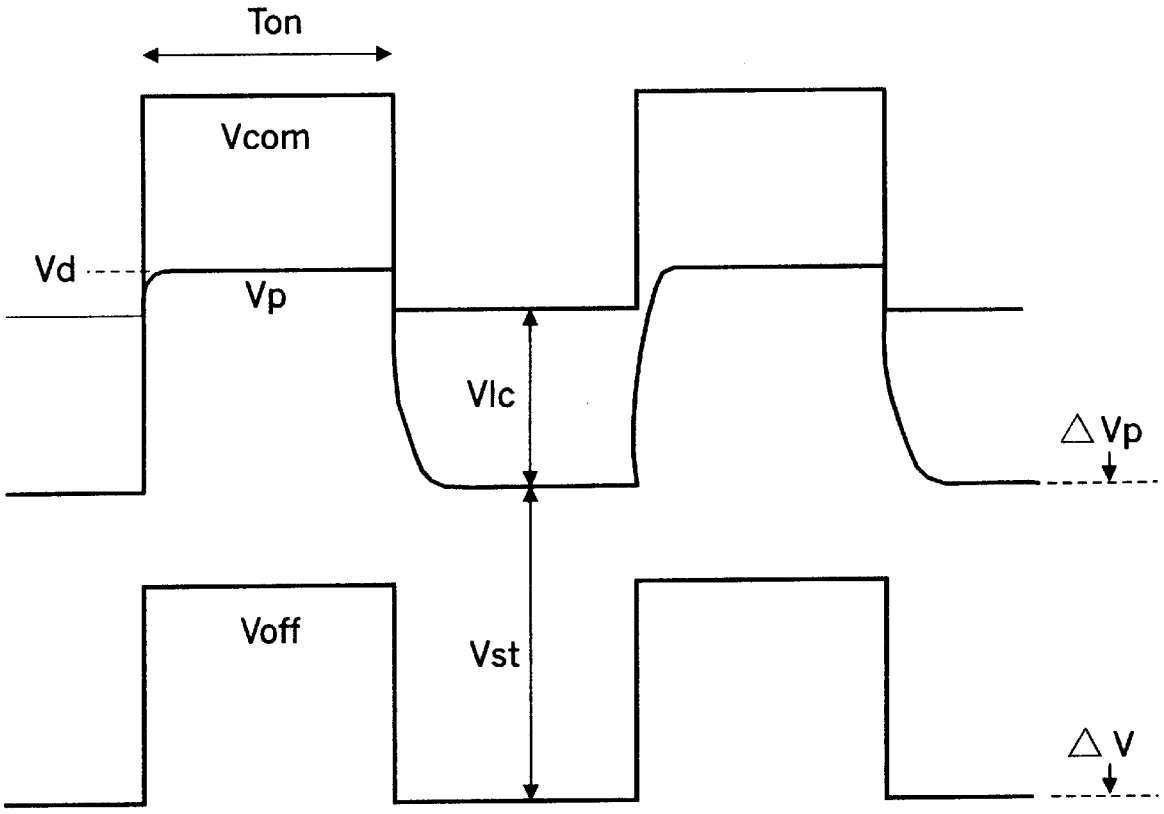
FIG. 2 Prior Art
FIG. 2 illustrates voltage waveforms for operating a TFT LCD according to the prior art.

Operation of an LCD according to the present invention will now be described. As illustrated in FIG. 7, an LCD element transmits light, e.g., backlighting, according to the amount of voltage applied across the electrodes of the liquid crystal element. For the normally white mode liquid crystal element characteristic illustrated, the transmittance of the liquid crystal element decreases as the voltage across the electrodes increases, thus causing the element to appear darker as the voltage across the element increases. Thus, as those skilled in the art will appreciate, the operating voltages which are applied to the electrodes of the liquid crystal element define a transmittance characteristic for the LCD element. For example, if a periodic voltage is applied across the liquid crystal element having a given magnitude and DC bias, the element will exhibit an average transmissivity, and consequently, an average brightness, which corresponds to the average voltage applied across the liquid crystal element. The present invention varies the transmittance characteristics of a row of LCD elements in an LCD by varying the magnitude and DC bias of the voltage applied to the storage capacitors connected to the liquid crystal elements of the row of LCD elements to achieve a predetermined transmittance characteristic.

Figure 5:
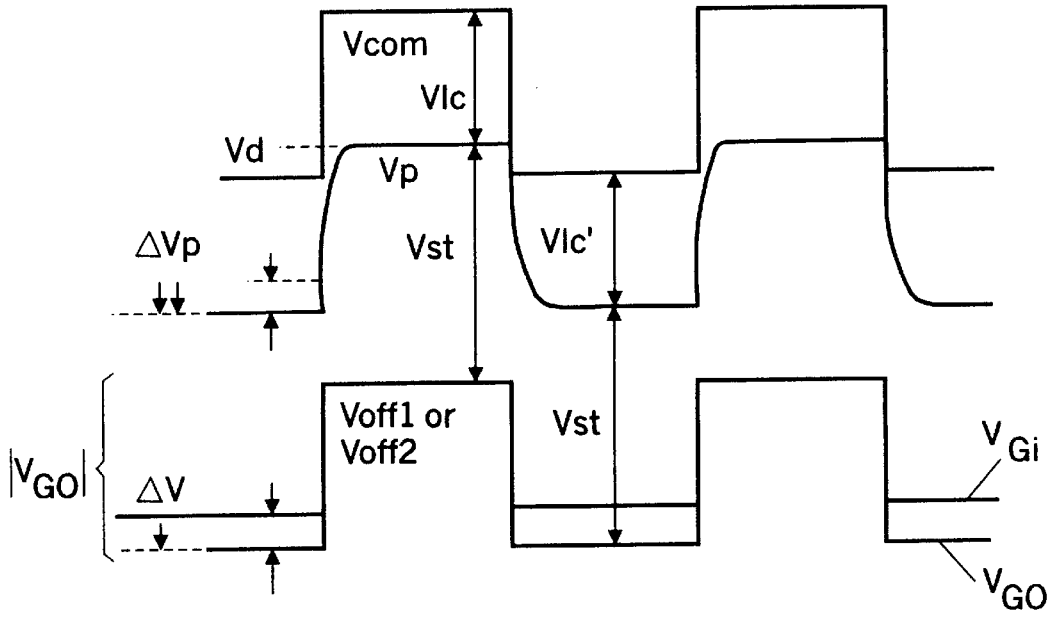
FIG. 5 illustrates voltage waveforms for operating a TFT LCD according to the present invention.

FIG. 5 illustrates a gate driving voltage $V_{Gi}$ applied to a normal gate line, i.e., to storage capacitors other than those in the first row of LCD elements $LCD_{11}$, $LCD_{12}$, in comparison to a periodic driving voltage $V_{G0}$ applied to the first electrodes of the storage capacitors $C_{st11}$, $C_{st12}$ of the first row of LCD elements $LCD_{11}$, $LCD_{12}$ of the LCD panel 100. Typically, the normal gate line voltage $V_{Gi}$ is in phase with the common electrode driving voltage Vcom with a fixed DC bias with respect to Vcom. In contrast, the periodic driving voltage $V_{G0}$ applied to the dummy gate line G0 may have a magnitude $|V_{G0}|$ which varies from that of the normal gate driving voltage $V_{Gi}$ by an amount $\Delta V$ and has a DC offset $\Delta V/2$ with respect to the normal gate driving voltage $V_{Gi}$.

As a result, the voltage Vlc across the liquid crystal elements $C_{lc11}$ and the voltage across the storage capacitor $C_{st11}$ may be varied from the corresponding voltages for other rows of the LCD panel to compensate for the different RC characteristic of the dummy gate line G0. For example, the periodic driving voltage $V_{G0}$ may have a peak to peak amplitude which is greater by an amount $\Delta V$, and accordingly, if the waveforms are as illustrated in FIG. 5, the voltage Vlc11' across the liquid crystal element Clc11 during the lower voltage period of the common electrode driving voltage Vcom is increased by an amount $\Delta Vp$. This can result in an average pixel electrode voltage increase of $\Delta Vp/2$, leading to reduced average brightness for a normally white mode LCD element.

Figure 6:
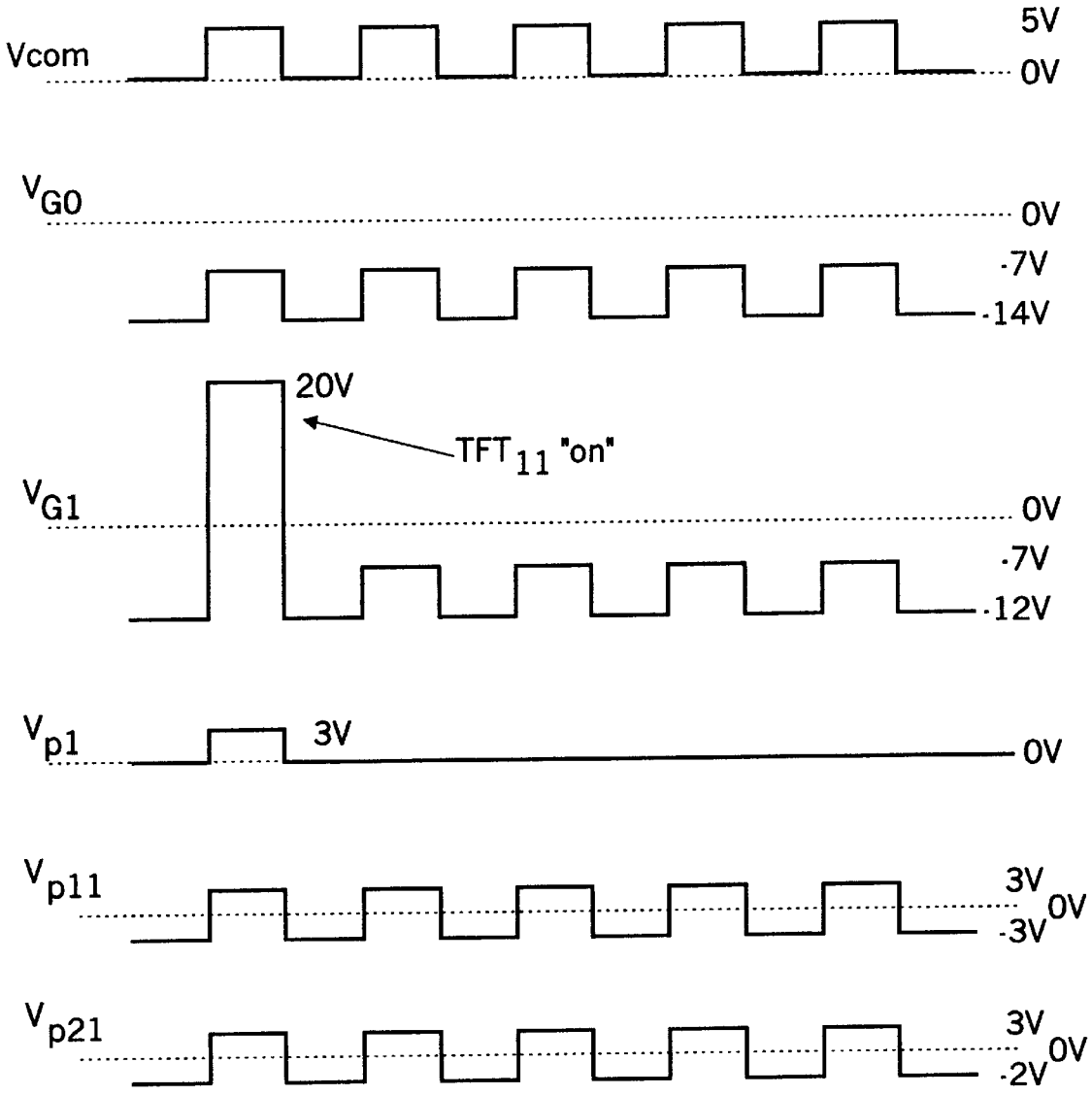
FIG. 6 illustrates exemplary waveforms for operating an LCD according to the present invention.

FIG. 6 is a waveform diagram which illustrates how a periodic driving voltage applied to the dummy gate line G0 of the LCD panel 100 of FIG. 3 can be used to vary the brightness of the first row of LCD elements $LCD_{11}$, $LCD_{12}$. A gate driving voltage $V_{G1}$ is applied to the gate of the thin film transistor $TFT_{11}$ of an LCD element of the first row of the panel. A data voltage $V_{D1}$ of 3 V is applied to a liquid crystal element $C_{lc11}$ of the first row by turning "on" the associated thin film transistor $TFT_{11}$, after which the gate driving voltage VG1 alternates between −7 V and −12 V, i.e., has a peak to peak magnitude of 5 V and a DC offset of −9.5 V. In contrast, the periodic voltage $V_{G0}$ applied to the dummy gate line G0 has a peak to peak magnitude of 7 V and a DC bias of −10.5 V. This results in a pixel electrode voltage $V_{p11}$ being applied to the pixel electrode of the liquid crystal element $C_{lc11}$ of the LCD element $LCD_{11}$ of the first row which has a 6 V magnitude and a zero volt DC bias, while the pixel electrode voltage Vp21 applied to an LCD element $LCD_{21}$ of a second row has a magnitude of 5 V and a DC bias of +1 V, assuming the same 3 V data voltage $V_{D1}$ has been applied to this element.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A liquid crystal display (LCD), comprising:

a plurality of thin-film-transistor (TFT) LCD elements arranged in a plurality of rows, a respective one of said TFT LCD elements including a liquid crystal element having a pixel electrode and a common electrode, a storage capacitor having a first electrode and a second electrode connected to said pixel electrode, and a transistor having a controlled electrode connected to said pixel electrode and a gate electrode which controls current through said controlled electrode;

common electrode driving means, connected to said common electrodes of said liquid crystal elements of said plurality of TFT LCD elements, for applying a common electrode voltage to said common electrodes of said liquid crystal elements of said plurality of TFT LCD elements;

gate driving means, electrically connected to the gate electrodes of said plurality of TFT LCD elements, for applying a respective gate driving voltage to the gate electrodes of a respective row of said TFT LCD elements and to the first electrodes of the storage capacitors of another row of TFT LCD elements other than a first row of TFT LCD elements; and first row storage capacitor driving means, responsive to said common electrode driving means and electrically connected to the first electrodes of the storage capacitors of said first row of TFT LCD elements, for applying a periodic driving voltage to said first electrodes of said storage capacitors of said first row of TFT LCD elements responsive to said common electrode voltage, such that said first row of LCD elements operate according to a predetermined transmittance characteristic.

2. An LCD according to claim 1, wherein said first row storage capacitor driving means applies a periodic driving voltage to said first electrodes of said storage capacitors of said first row of TFT LCD elements such that said plurality of rows of TFT LCD elements operate according to approximately the same transmittance characteristic.

3. An LCD according to claim 1, wherein said periodic driving voltage has a predetermined phase with respect to said common electrode voltage.

4. An LCD according to claim 3, wherein said first row storage capacitor driving means comprises:

a voltage transforming circuit including an input node and an output node, said input node being electrically connected to said common electrodes of said plurality of TFT LCD elements, said voltage transforming circuit producing a periodic voltage at said output node, said periodic voltage having a predetermined phase, a predetermined magnitude and a predetermined DC bias with respect to said common electrode voltage; and means for coupling said output node of said voltage transforming circuit to said first electrodes of said storage capacitors of said first row of TFT LCD elements to thereby produce said periodic driving voltage on said first electrodes of said storage capacitors of said first row of TFT LCD elements from said generated periodic voltage.

5. An LCD according to claim 4, wherein said coupling means comprises:

a dummy gate line connected to the second electrodes of said storage capacitors of said first row of said plurality of TFT LCD elements; and a gate driver, electrically connected to said output node of said voltage transforming circuit and to said dummy gate line, which receives the generated periodic voltage and produces said periodic driving voltage on said dummy gate line therefrom.

6. An LCD according to claim 4, wherein said voltage transforming circuit comprises:

a resistor having a first electrode and a second electrode, said first electrode being connected to a first voltage source;

a diode having anode and a cathode, said cathode being connected to said second electrode of said resistor;

a capacitor having a first electrode connected to said common electrodes of said plurality of TFT LCD elements and a second electrode connected to said anode of said diode;

a first transistor having a first controlled electrode, a second controlled electrode and a gate electrode with controls current between said first and second controlled electrodes, said first controlled electrode being connected to said second electrode of said capacitor and said gate electrode being connected to a second voltage source; and a second transistor having a first controlled electrode, a second controlled electrode and a gate electrode which controls current between said first and said second controlled electrodes, said first controlled electrode being connected to said anode of said diode, said gate electrode being connected to said second voltage source, and said second controlled electrode being connected to said second controlled electrode of said first transistor at said output node.

7. An LCD according to claim 6, wherein said first and second voltage sources supply respective first and second predetermined DC voltages which bias said voltage transforming circuit to produce a periodic voltage at said output node which is sufficient to operate said first row of LCD elements according to said predetermined transmittance characteristic.

8. An LCD according to claim 6, wherein said first transistor comprises a PMOS transistor and wherein said second transistor comprises an NMOS transistor.

9. An LCD according to claim 4, wherein said voltage transforming circuit comprises:

a resistor having a first electrode and a second electrode, said first electrode being electrically connected to a first voltage source;

a first diode having an anode and a cathode, said cathode being connected to said second electrode of said resistor;

a first capacitor having a first electrode electrically connected to said common electrodes of said plurality of TFT LCD elements and a second electrode connected to said anode of said first diode;

a first transistor having a first controlled electrode, a second controlled electrode and a gate electrode with controls current between said first and second controlled electrodes, said first controlled electrode being connected to said first electrode of said capacitor and said gate electrode being connected to a second voltage source;

a second transistor having a first controlled electrode, a second controlled electrode and a gate electrode which controls current between said first and said second controlled electrodes, said first controlled electrode being connected to said anode of said diode, said gate electrode being connected to said second voltage source, and said second controlled electrode being connected to said second controlled electrode of said first transistor at said output node;

a second capacitor having a first electrode and a second electrode, said first electrode being connected to said second controlled electrodes of said first and second transistors at said output node; and a second diode having an anode connected to said second electrode of said second capacitor and a first electrode connected to a third voltage source.

10. An LCD according to claim 9, wherein said first, second and third voltage sources supply respective first, second and third predetermined DC voltages which bias said voltage transforming circuit to produce a periodic voltage at said output node which is sufficient to operate said first row of LCD elements according to a predetermined transmittance characteristic.

11. An LCD according to claim 9, wherein said first transistor comprises a PMOS transistor and wherein said second transistor comprises an NMOS transistor.

12. An LCD according to claim 4, wherein said voltage transforming circuit comprises:

a resistor having a first electrode and a second electrode, said first electrode being electrically connected to a first voltage source;

a first diode having an anode and a cathode, said cathode being connected to said second electrode of said resistor;

a first capacitor having a first electrode electrically connected to said common electrodes of said plurality of TFT LCD elements and a second electrode connected to said anode of said first diode;

a first transistor having a first controlled electrode, a second controlled electrode and a gate electrode with controls current between said first and second controlled electrodes, said first controlled electrode being connected to said first electrode of said capacitor and said gate electrode being connected to a second voltage source;

a second transistor having a first controlled electrode, a second controlled electrode and a gate electrode which controls current between said first and said second controlled electrodes, said first controlled electrode being connected to said anode of said diode, said gate electrode being connected to said second voltage source, and said second controlled electrode being connected to said second controlled electrode of said first transistor;

a second capacitor having a first electrode and a second electrode, said first electrode being connected to said second controlled electrodes of said first and second transistors; and a second diode having an anode connected to said second electrode of said second capacitor at said output node and a first electrode connected to a third voltage source.

13. An LCD according to claim 12, wherein said first, second and third voltage sources supply respective first, second and third predetermined DC voltages which bias said voltage transforming circuit to produce a periodic voltage at said output node which is sufficient to operate said first row of LCD elements according to a predetermined transmittance characteristic.

14. An LCD according to claim 12, wherein said first transistor comprises a PMOS transistor and wherein said second transistor comprises an NMOS transistor.

15. An LCD according to claim 4, wherein said voltage transforming circuit comprises means for adjusting said magnitude and said DC bias of said periodic voltage to thereby adjust said magnitude and said DC bias of said periodic driving voltage.

16. A method of operating a liquid crystal display (LCD) including a plurality of thin-film-transistor (TFT) LCD elements arranged in a plurality of rows, a respective one of the TFT LCD elements including a liquid crystal element having a pixel electrode and a common electrode, a storage capacitor having a first electrode and a second electrode connected to the pixel electrode, and a transistor having a controlled electrode connected to the pixel electrode and a gate electrode which controls current through the controlled electrode, the method comprising the steps of:

applying a common electrode voltage to the common electrodes of the liquid crystal elements of the plurality of TFT LCD elements;

applying a respective gate driving voltage to the gate electrodes of a respective row of the TFT LCD elements and to the first electrodes of the storage capacitors of another row of TFT LCD elements other than a first row of TFT LCD elements; and applying a periodic driving voltage to the first electrodes of the storage capacitors of the first row of TFT LCD elements responsive to the common electrode voltage, such that the first row of LCD elements operates according to a first predetermined transmittance characteristic.

17. A method according to claim 16, wherein said steps of applying a common electrode voltage and applying a respective gate driving voltage operate the rows of TFT LCD elements other than the first row of TFT LCD elements operate according to a second predetermined transmittance characteristic and wherein said step of applying a periodic driving voltage comprises the step of applying a periodic driving voltage to the first electrodes of the storage capacitors of the first row of TFT LCD elements having a magnitude and a DC bias sufficient to operate the first row of LCD elements according to a first predetermined transmittance characteristic which approximates the second predetermined transmittance characteristic.

18. A method according to claim 17, wherein said step of applying a periodic driving voltage comprises the step of applying a periodic driving voltage having a predetermined phase with respect to the common electrode voltage.

19. A method according to claim 18, wherein said step of applying a periodic driving voltage is preceded by the step of producing the periodic driving voltage from the common electrode voltage.

20. A method of operating a liquid crystal display (LCD) including a plurality of thin-film-transistor (TFT) LCD elements arranged in a plurality of rows, a respective one of the TFT LCD elements including a liquid crystal element having a pixel electrode and a common electrode, a storage capacitor having a first electrode and a second electrode connected to the pixel electrode, and a transistor having a controlled electrode connected to the pixel electrode and a gate electrode which controls current through the controlled electrode, the storage capacitors of a respective row of a plurality of rows of TFT LCD elements being connected by a respective gate line of a plurality of gate lines, the storage capacitors of a first row of TFT LCD elements other that the plurality of rows being commonly connected by a dummy gate line, the method comprising the steps of:

applying a respective one of a plurality of gate driving voltages to a respective one of the gate lines to operate the plurality of rows of TFT LCD elements according to a first predetermined transmittance characteristic; and applying a periodic driving voltage to the dummy gate line of the row of TFT LCD elements, the periodic driving voltage having a magnitude and a DC bias to compensate for a differing impedance characteristic of the dummy gate line with respect to the plurality of gate lines and thereby operate the first row of LCD elements according to a second transmittance characteristic which approximates the first predetermined transmittance characteristic.

21. A method according to claim 20, further comprising the step of:

applying a common electrode voltage to the common electrodes of the liquid crystal elements of the plurality of TFT LCD elements; and wherein said step of applying a periodic driving voltage comprises the step of applying a periodic driving voltage having a predetermined phase with respect to the common electrode voltage.

22. A method according to claim 21, wherein said step of applying a periodic driving voltage is preceded by the step of producing the periodic driving voltage from the common electrode voltage.

* * * * *